US009037042B2

(12) United States Patent
Kato et al.

(10) Patent No.: US 9,037,042 B2
(45) Date of Patent: May 19, 2015

(54) IMAGE FORMING APPARATUS

(71) Applicants: Yuji Kato, Kanagawa (JP); Yasufumi Takahashi, Tokyo (JP); Osamu Ichihashi, Kanagawa (JP)

(72) Inventors: Yuji Kato, Kanagawa (JP); Yasufumi Takahashi, Tokyo (JP); Osamu Ichihashi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 10 days.

(21) Appl. No.: 13/845,780

(22) Filed: Mar. 18, 2013

(65) Prior Publication Data

US 2013/0243482 A1 Sep. 19, 2013

(30) Foreign Application Priority Data

Mar. 19, 2012 (JP) ..... 2012-061737
Oct. 30, 2012 (JP) ..... 2012-238843

(51) Int. Cl.
*G03G 15/16* (2006.01)
*G03G 15/14* (2006.01)
*G03G 15/01* (2006.01)

(52) U.S. Cl.
CPC ..... *G03G 15/14* (2013.01); *G03G 15/0131* (2013.01); *G03G 15/161* (2013.01); *G03G 15/0189* (2013.01); *G03G 15/168* (2013.01)
USPC ..... 399/121; 399/167; 399/308; 399/317

(58) Field of Classification Search
USPC ..... 399/66, 121, 167, 297, 317
See application file for complete search history.

(56) References Cited

U.S. PATENT DOCUMENTS 7,856,194 B2 * 12/2010 Murakami ..... 399/121
2006/0062593 A1 3/2006 Takahashi
2007/0036585 A1 * 2/2007 Ochi ..... 399/121
2007/0104510 A1 * 5/2007 Kawai et al. ..... 399/167
2009/0162114 A1 * 6/2009 Nakura et al. ..... 399/308
2009/0245869 A1 * 10/2009 Nieda ..... 399/167
2009/0257779 A1 * 10/2009 Shimura et al. ..... 399/167
2010/0098465 A1 4/2010 Saito
2010/0142985 A1 6/2010 Minbe et al.
2010/0221029 A1 9/2010 Minbu et al.

(Continued)

FOREIGN PATENT DOCUMENTS

JP 2002-296927 10/2002
JP 2004-144878 5/2004

OTHER PUBLICATIONS

Chinese Office Action for application No. 201310086322.8 dated Jan. 29, 2015.

*Primary Examiner* — Francis Gray
(74) *Attorney, Agent, or Firm* — Harness, Dickey & Pierce, P.L.C.

(57) ABSTRACT

An image forming apparatus includes: a transfer unit that is detachably attachable to a housing of the image forming apparatus and includes: a transfer member configured to contact the image carrier; a movable frame that supports the transfer member and configured to rotate around a fulcrum shaft; a driving input member coaxially arranged with the fulcrum shaft and configured to connect to a first driving transmitting member, and a second driving transmitting member supported by the movable frame and configured to transmit a driving force inputted by the driving input member to the transfer member. The image forming apparatus further includes a contact/separation unit configured to press the transfer member against the image carrier and to separate the transfer member from the image carrier by moving the movable frame around the fulcrum shaft while the transfer unit is attached to the image forming apparatus.

19 Claims, 9 Drawing Sheets

(56) References Cited

U.S. PATENT DOCUMENTS

| | | | | |
|---|---|---|---|---|
| 2010/0272478 | A1 | 10/2010 | Ichihashi | |
| 2011/0064487 | A1 | 3/2011 | Ichihashi et al. | |
| 2011/0158690 | A1* | 6/2011 | Mimbu et al. | 399/121 |
| 2011/0206399 | A1 | 8/2011 | Fujita et al. | |
| 2011/0286759 | A1 | 11/2011 | Ichihashi et al. | |
| 2012/0121293 | A1 | 5/2012 | Mimbu et al. | |
| 2012/0148300 | A1 | 6/2012 | Katoh et al. | |
| 2012/0224879 | A1 | 9/2012 | Fujita et al. | |
| 2012/0237233 | A1 | 9/2012 | Kato et al. | |
| 2012/0237260 | A1 | 9/2012 | Sengoku et al. | |
| 2013/0064572 | A1* | 3/2013 | Shiba et al. | 399/121 |
| 2013/0114982 | A1* | 5/2013 | Ichihashi et al. | 399/298 |

* cited by examiner

IMAGE FORMING APPARATUS

CROSS-REFERENCE TO RELATED APPLICATIONS

The present application claims priority to and incorporates by reference the entire contents of Japanese Patent Application No. 2012-061737 filed in Japan on Mar. 19, 2012 and Japanese Patent Application No. 2012-238843 filed in Japan on Oct. 30, 2012.

BACKGROUND OF THE INVENTION

1. Field of the Invention

The present invention relates to an image forming apparatus such as a copying machine, a printer, a facsimile, or a multifunctional peripheral (MFP) including these functions thereof, to be more specific, relates to an image forming apparatus including an image carrier that carries a toner image and a transfer member that abuts against the image carrier in a pressurized manner to form a transfer nip and transfers the toner image onto a recording medium.

2. Description of the Related Art

In electrophotography image forming apparatuses using intermediate transfer members such as intermediate transfer belts and secondary transfer units including secondary transfer rollers, there has been a problem that positions of the intermediate transfer member and the secondary transfer unit are difficult to be defined with a configuration in which the secondary transfer unit is fixed onto a drawer that can be drawn from an image forming apparatus main body. Therefore, positional accuracy of the secondary transfer unit and the intermediate transfer member has been enhanced by fixing the secondary transfer unit onto the drawer with high accuracy.

For example, in Japanese Patent Application Laid-open No. 2004-144878, the following configuration has been disclosed. That is, a secondary transfer device is held on a sub housing in an unfixed state through a biasing unit, and if the sub housing is accommodated in a main housing for holding a secondary transfer belt, the secondary transfer device is positioned with respect to the secondary transfer belt in the main scanning direction with a biasing force of the biasing unit. In Japanese Patent Application Laid-open No. 2004-144878, the alignment accuracy of the members on a so-called drawer is guaranteed so as to try to ensure stable conveyance property and image quality. Furthermore, in Japanese Patent Application Laid-open No. 2002-296927, the following configuration has been disclosed. That is, an outer diameter of a swing support shaft is manufactured to be slightly smaller than an inner diameter of a fitting hole of a support frame into which the swing support shaft is fitted so as to make a fitting portion have backlash for keeping a pressing force to be substantially uniform when a transfer device is positioned and is made to abut against an image carrier, and positional deviation and parallelism are corrected with the backlash.

However, with the configuration in which the secondary transfer unit is positioned on the drawer strictly, accuracy of the secondary transfer unit and the intermediate transfer belt is not obtained sufficiently due to deflection or tolerance of the drawer, resulting in adverse influence on image formation with high image quality.

There is a need to fix a transfer member and an image carrier with high accuracy and make it possible to prevent deterioration in image quality due to pressure deviation or the like.

SUMMARY OF THE INVENTION

It is an object of the present invention to at least partially solve the problems in the conventional technology.

An image forming apparatus includes: an image carrier that carries a toner image; a driving source; a first driving transmitting member configured to be driven by a driving force generated by the driving source; and a transfer unit that is detachably attachable to a housing of the image forming apparatus. The transfer unit includes: a transfer member configured to contact the image carrier directly or via a recoding medium to form a transfer nip and transfer the toner image on the image carrier onto the recording medium passing through the transfer nip; a guide configured to guide the transfer unit to the image carrier; a fulcrum shaft; a movable frame that supports the transfer member and configured to rotate around the fulcrum shaft; a driving input member coaxially arranged with the fulcrum shaft and configured to connect to the first driving transmitting member, and a second driving transmitting member supported by the movable frame and configured to transmit the driving force inputted by the driving input member to the transfer member. The image forming apparatus further includes a contact/separation unit configured to press the transfer member against the image carrier and to separate the transfer member from the image carrier by moving the movable frame around the fulcrum shaft while the transfer unit is attached to the image forming apparatus.

An image forming apparatus includes: an image carrier that carries a toner image; a transfer member that abuts against the image carrier to form a transfer nip and transfers the toner image on the image carrier onto a recording medium passing through the transfer nip; a transfer unit that supports the transfer member; a driving source that drives the transfer member; a contact/separation unit that causes the transfer member to abut against and to be separated from the image carrier; and a configuration that positions the transfer unit with respect to the image carrier. While the transfer member is driven in a state where the configuration positions the transfer unit, the contact/separation unit operates independently of driving of the transfer member.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 4A illustrates a front-side portion of the secondary transfer unit, FIG. 4B illustrates a rear-side portion of the secondary transfer unit, FIG. 4C illustrates a portion of a front side plate on an apparatus main body that is engaged with the front-side portion of the secondary transfer unit, and FIG. 4D illustrates a portion of a rear side plate on the apparatus main body that is engaged with the rear-side portion of the secondary transfer unit;

DETAILED DESCRIPTION OF THE PREFERRED EMBODIMENTS

Figure 1:
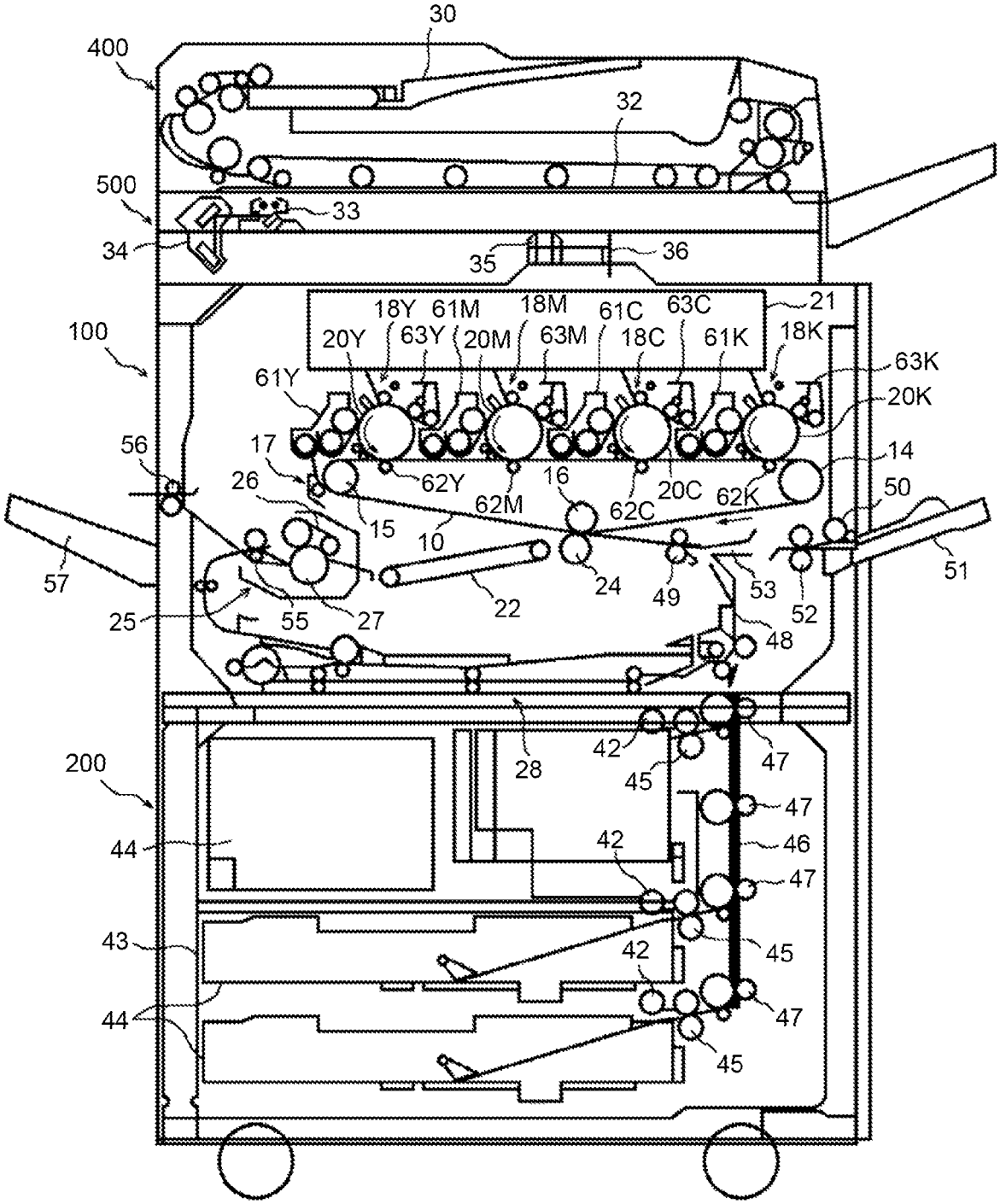
FIG. 1 is a schematic view illustrating a tandem-type color copying machine according to an embodiment of the present invention.

An embodiment of the present invention is described in detail with reference to the drawings. In FIG. 1 illustrating a tandem-type color copying machine as an image forming apparatus, a printer unit 100 includes an endless belt-like intermediate transfer belt 10. The intermediate transfer belt 10 is wound around a driving roller 14, a driven roller 15, and a secondary transfer counter roller 16 in a posture forming an inverted triangular shape with an apex pointing downward when seen from the front side of FIG. 1. The intermediate transfer belt 10 moves in the clockwise direction in FIG. 1 in an endless manner by rotational driving of the driving roller 14. Four image forming units 18Y, 18M, 18C, and 18K for forming toner images of yellow (Y), magenta (M), cyan (C), and black (K) are arranged above the intermediate transfer belt 10 so as to be aligned along the belt movement direction. A belt cleaning device 17 abuts against the surface of the intermediate transfer belt 10 before entering a primary transfer nip for Y. Note that a primary transfer process for Y is performed at the most-upstream side among four colors.

The image forming units 18Y, 18M, 18C, and 18K include photosensitive elements 20Y, 20M, 20C, and 20K, developing units 61Y, 61M, 61C, and 61K, and photosensitive element cleaning devices 63Y, 63M, 63C, and 63K, respectively. The respective photosensitive elements 20Y, 20M, 20C, and 20K abut against the intermediate transfer belt 10 so as to form primary transfer nips for Y, M, C, and K, respectively. The photosensitive elements 20Y, 20M, 20C, and 20K are driven rotationally in the counterclockwise direction in FIG. 1 by a driving unit (not illustrated). It is to be noted that the developing units 61Y, 61M, 61C, and 61K develop electrostatic latent images formed on the photosensitive elements 20Y, 20M, 20C, and 20K with Y, M, C, and K toners, respectively. Furthermore, the photosensitive element cleaning devices 63Y, 63M, 63C, and 63K clean transfer residual toners adhered to the photosensitive elements 20Y, 20M, 20C, and 20K after having passed through the primary transfer nips, respectively. In the copying machine in the embodiment, a tandem image forming portion is configured by four image forming units 18Y, 18M, 18C, and 18K aligned along the belt movement direction.

An optical writing unit 21 is arranged above the tandem image forming portion in the printer unit 100. The optical writing unit 21 performs optical writing processing with optical scanning on the surfaces of the photosensitive elements 20Y, 20M, 20C, and 20K that are driven rotationally in the counterclockwise direction in FIG. 1 so as to form electrostatic latent images. The surfaces of the photosensitive elements 20Y, 20M, 20C, and 20K are charged uniformly by uniform charging units of the image forming units 18Y, 18M, 18C, and 18K, respectively, before the respective pieces of optical writing processing.

The intermediate transfer unit including the intermediate transfer belt 10 includes primary transfer rollers 62Y, 62M, 62C, and 62K at the loop inner side of the intermediate transfer belt 10. These primary transfer rollers 62Y, 62M, 62C, and 62K pressurize the intermediate transfer belt 10 toward the photosensitive elements 20Y, 20M, 20C, and 20K at the back sides of the primary transfer nips for Y, M, C, and K, respectively.

A secondary transfer roller 24 as a transfer member constituting a secondary transfer unit (that is, transfer unit) is arranged under the intermediate transfer belt 10. The secondary transfer roller 24 abuts against the secondary transfer counter roller 16 at a place on which the intermediate transfer belt 10 is wound around the secondary transfer counter roller 16 from the belt surface side so as to form a secondary transfer nip (secondary transfer portion). In other words, the secondary transfer roller 24 contacts the intermediate transfer belt 10 directly or via a recoding medium to form a transfer nip. A sheet-like recording medium (hereinafter, referred to as sheet) is fed to the secondary transfer nip at a predetermined timing. Then, a four-color-superimposed toner image on the intermediate transfer belt 10 is secondary-transferred collectively onto the sheet on the secondary transfer nip. It is to be noted that a belt-like transfer belt may be used as the transfer member instead of the transfer roller having the roller shape.

On a scanner unit 500 located above the printer unit 100, image information of a document placed on a contact glass 32 is read by a reading sensor 36 through a first traveling member 33, a second traveling member 34, and an imaging lens 35 and the read image information is fed to a controller of the printer unit 100. The controller (not illustrated) controls a light source such as a laser diode and an LED on the optical writing unit 21 of the printer unit 100, outputs laser writing light components for Y, M, C, and K, and scans the photosensitive elements 20Y, 20M, 20C, and 20K optically based on the image information received from the scanner unit 500. The electrostatic latent images are formed on the surfaces of the photosensitive elements 20Y, 20M, 20C, and 20K with the optical scanning, and are developed to Y, M, C, and K toner images through predetermined developing processes.

A paper feeding unit 200 located under the printer unit 100 includes paper feeding rollers 42, separation rollers 45, and conveying rollers 47. The paper feeding rollers 42 feed sheets from paper cassettes 44 arranged in a paper bank 43 at multiple stages. The separation rollers 45 separate the fed sheets and introduce the sheets to a paper feeding path 46. The conveying rollers 47 convey the sheets to a paper feeding path 48 of the printer unit 100.

As paper feeding, bypass paper feeding can be performed in addition to paper feeding by using the paper feeding unit 200. A bypass tray 51 for bypass and a separation roller 52 are also provided. The separation roller 52 separates sheets on the bypass tray 51 toward a bypass paper feeding path 53 one by one. The bypass paper feeding path 53 joins together with the paper feeding path 48 in the printer unit 100.

A registration roller pair 49 is arranged in the vicinity of a terminal end of the paper feeding path 48. The registration roller pair 49 nips the sheet to be transported in the paper feeding path 48 between the rollers, and then, feeds the sheet toward the secondary transfer nip at a predetermined timing.

Operations on the copying machine in the embodiment are described. When a color image is copied, a document is set on a document table 30 of an automatic document feeder (ADF) 400 attached above the scanner unit 500. Alternatively, in such a case, the ADF 400 is opened, the document is set on the contact glass 32 of the scanner unit 500, and the ADF 400 is closed to keep the document. Then, a start switch (not illustrated) is pressed. With this, when the document has been set on the ADF 400, the document is conveyed onto the contact glass 32. Thereafter, the scanner unit 500 starts to be driven and the first traveling member 33 and the second traveling member 34 start to travel along the document surface. On the first traveling member 33, light emitted from the light source is applied onto the document surface and obtained reflected light is turned back and directed to the second traveling member 34. The turned light is further turned back by a mirror of the second traveling member 34, and then, is incident on the reading sensor 36 through the imaging lens 35. With this, document contents are read.

If the controller of the printer unit 100 receives image information from the scanner unit 500, the controller issues a direction to the paper feeding unit 200 so as to feed out a sheet having a size based on the image information to the paper feeding path 48. In accordance therewith, the driving roller 14 is driven rotationally by a driving motor (not illustrated) so as to move the intermediate transfer belt 10 in the clockwise direction in FIG. 1 in the endless manner. At the same time, the photosensitive elements 20Y, 20M, 20C, and 20K of the image forming units 18Y, 18M, 18C, and 18K are started to be driven rotationally, and then, the uniform charging processing, the optical writing processing, the developing processing, and the like are performed on the photosensitive elements 20Y, 20M, 20C, and 20K. The toner images of Y, M, C, and K that have been formed on the surfaces of the photosensitive elements 20Y, 20M, 20C, and 20K with these pieces of processing are superimposed on one another sequentially on the primary transfer nips for Y, M, C, and K and are primary-transferred onto the intermediate transfer belt 10. With this, the four-color-superimposed toner image is formed.

On the paper feeding unit 200, one of the paper feeding rollers 42 is rotated selectively in accordance with a sheet size and sheets are fed out from the paper cassette 44 to which the rotating paper feeding roller belongs based on the direction from the controller of the printer unit 100 as described above. The sheets that have been fed out are separated by the separation roller 45 one by one and the separated sheet is introduced to the paper feeding path 46. Then, the sheet is fed to the paper feeding path 48 in the printer unit 100 through the conveying rollers 47. Furthermore, when the bypass tray 51 is used, the paper feeding roller 50 of the tray is driven rotationally. Then, the sheets on the tray are fed to the bypass paper feeding path 53 while being separated by the separation roller 52 and the sheet reaches the vicinity of the terminal end of the paper feeding path 48. A front end of the sheet hits the registration roller pair 49 in the vicinity of the terminal end of the paper feeding path 48 and the sheet stops. Thereafter, if the registration roller pair 49 is driven rotationally at a timing that can be synchronized with the four-color-superimposed toner image on the intermediate transfer belt 10, the sheet is fed into the secondary transfer nip and is close contact with the four-color-superimposed toner image on the belt. Then, the four-color-superimposed toner image is secondary-transferred collectively onto the sheet by influence of a nip pressure, a transfer electric field, and the like.

The sheet on which the four-color-superimposed toner image has been secondary-transferred on the secondary transfer nip is fed into a fixing device 25 by a paper conveying belt 22. Then, the sheet is nipped by a fixing nip between a pressing roller 27 and a fixing belt 26 on the fixing device 25. With this, the four-color-superimposed toner image is fixed onto the sheet surface with pressing and heating processing. The sheet on which the color image has been formed in this manner is stacked on a discharge tray 57 at the outside of the apparatus through a discharge roller pair 56.

It is to be noted that when an image is also formed on another surface of the sheet, the sheet is fed to a sheet reversing device 28 by course switching by a switching claw 55 after having been discharged from the fixing device 25. Then, after the sheet has been reversed upside down, the sheet is returned to the registration roller pair 49, again. Thereafter, the sheet passes through the secondary transfer nip and the fixing device 25, again.

Figure 2:
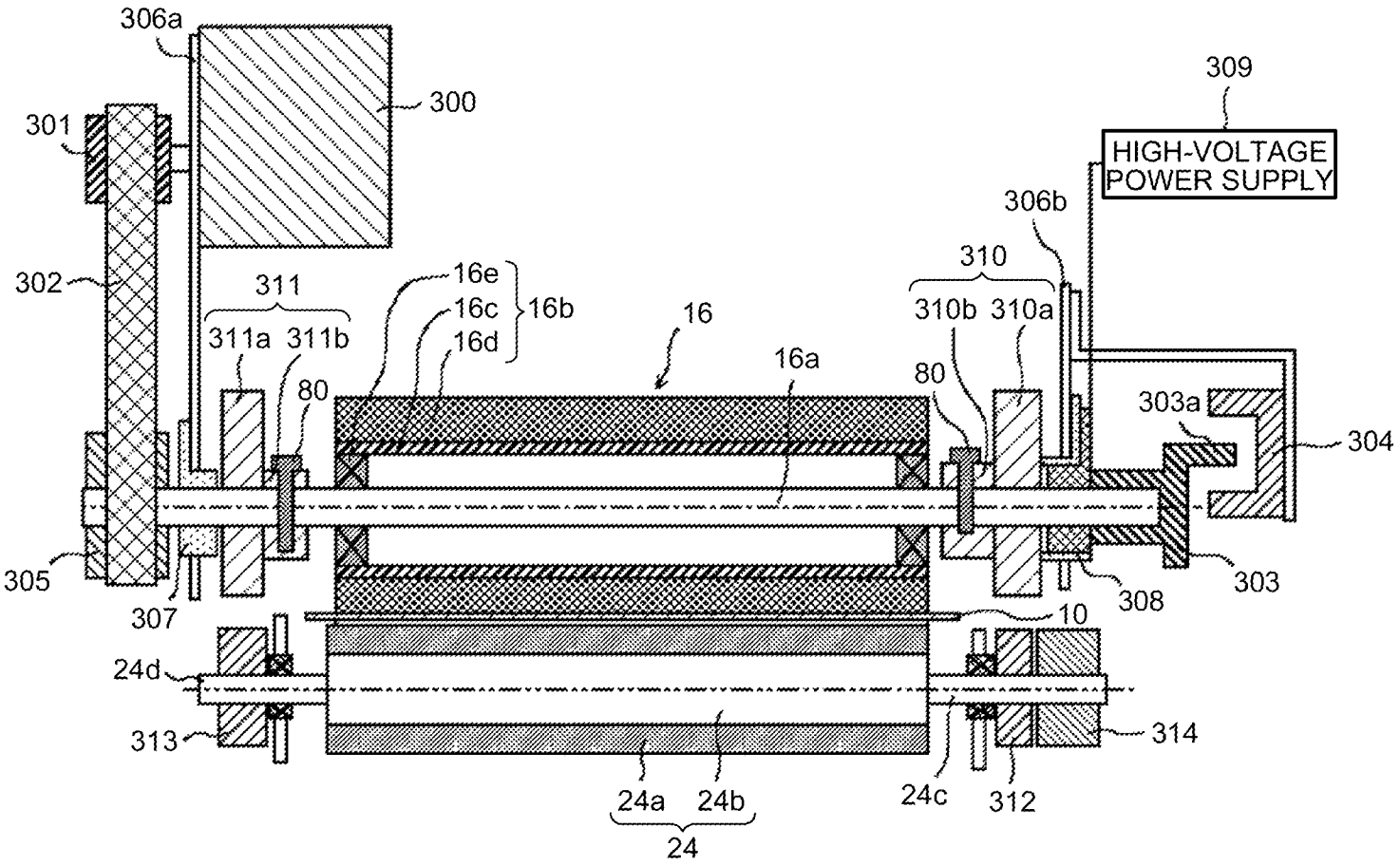
FIG. 2 is a schematic plan view for explaining a peripheral configuration relating to abutment/separation operations of secondary transfer.

FIG. 2 is a view illustrating a peripheral configuration relating to abutment and separation operations of the secondary transfer portion. The secondary transfer roller 24 includes a cylindrical hollow cored bar 24*b* and an elastic layer 24*a*. The elastic layer 24*a* is made of an elastic material and is fixed to a circumferential surface of the cylindrical hollow cored bar 24*b*. The secondary transfer roller 24 further includes a first shaft member 24*c* and a second shaft member 24*d*, and a first idling roller 312 and a second idling roller 313, which will be described later. The first shaft member 24*c* and the second shaft member 24*d* project from both end surfaces in the shaft line direction and extend in the rotating shaft line direction. It is to be noted that a configuration in which the idling rollers 312 and 313 as the idling members are supported on the shaft members 24*c* and 24*d* through bearings or the like may be employed instead of the configuration in which the idling rollers 312 and 313 are supported directly on the shaft members 24*c* and 24*d* of the secondary transfer roller 24.

As a metal forming the hollow cored bar 24*b*, stainless, aluminum, or the like can be exemplified but the material is not limited thereto. The elastic layer 24*a* fixed onto the circumferential surface of the hollow cored bar 24*b* is made of a conductive rubber material having a resistance value having been adjusted so as to exhibit a resistance of approximately 7.5 Log Ω. As the rubber material exhibiting conductivity, conductive epichlorohydrin rubber, EPDM rubber or Si rubber in which carbon is dispersed, NBR rubber or urethane rubber having an ion conducting function, or the like can be used. The electric resistance of the elastic layer 24*a* is adjusted to be in a predetermined range in order to prevent the following failure from occurring. That is, the failure that a transfer current is concentrated on a place on which the belt and the roller make direct contact with each other with no sheet interposed therebetween in the secondary transfer nip when a sheet having a relatively small size in the roller shaft line direction, such as an A5 size, is used is prevented from occurring. The electric resistance of the elastic layer 24*a* is set to be a value that is larger than a resistance of the sheet, thereby suppressing the above-mentioned concentration of the transfer current.

It is desirable that the elastic layer 24*a* has JIS-A hardness of equal to or lower than 70 degrees. In particular, when a cleaning blade (not illustrated) is made to abut against the secondary transfer roller 24, various failures occur if the elastic layer 24*a* is too soft. Therefore, it is desirable that the elastic layer 24*b* is ensured to have JIS-A hardness of equal to or higher than 40 degrees. When no cleaning unit is provided on the secondary transfer roller 24, the elastic layer 24*b* is made soft so as to reduce an abnormal image that is formed due to impact when the recording medium enters and exits from the secondary transfer portion. Therefore, as the conductive rubber material forming the elastic layer 24*b*, expandable rubber is used so as to have Asker-C hardness of approximately 35 degrees. If the elastic layer 24*a* is formed with such expandable rubber, the elastic layer 24*a* is deformed flexibly in the thickness direction in the secondary transfer nip, so that a secondary transfer nip having an area to some extent in the sheet conveyance direction can be formed.

Furthermore, the elastic layer 24*a* has a drum shape with an outer diameter at a center portion larger than outer diameters at end portions by some extent. If the elastic layer 24*a* has the drum shape, when the secondary transfer roller 24 integrated with a secondary transfer unit 350 (see FIG. 3) is biased toward the intermediate transfer belt 10 with a biasing coil spring 351 (see FIG. 3) to form a nip, a problem that deflection is generated and a pressure at the center portion escapes can be prevented from occurring.

The secondary transfer counter roller 16 in the intermediate transfer belt 10 that is biased with a spring by the secondary transfer roller 24 having the above-mentioned configuration includes a roller portion 16*b* and a penetrating shaft member 16*a*. The roller portion 16*b* is a cylindrical main body portion. The penetrating shaft member 16*a* penetrates through a rotating center portion of the roller portion 16*b* in the rotating shaft line direction. The penetrating shaft member 16*a* allows the roller portion 16*b* to rotate relative to the penetrating shaft member 16*a* on the surface thereof. The roller portion 16*b* that can rotate freely relative to penetrating shaft member 16*a* the on the circumferential surface of the penetrating shaft member 16*a* made of a metal includes a drum-like hollow cored bar 16*c*, an elastic layer 16*d*, and ball shaft bearings 16*e*. The elastic layer 16*d* is fixed onto an outer circumferential surface of the hollow cored bar 16*c* and is made of an elastic material. The ball shaft bearings 16*e* are pressed into both ends of the hollow cored bar 16*c* in the shaft line direction. The ball shaft bearings 16*e* rotate on the penetrating shaft member 16*a* together with the elastic layer 16*d* and the hollow cored bar 16*c* while being supported on the hollow cored bar 16*c*.

The penetrating shaft member 16*a* is supported by a first shaft bearing 308 and a second shaft bearing 307 in a freely rotatable manner. The first shaft bearing 308 is fixed onto a first side plate 306*b* of the intermediate transfer unit on which the intermediate transfer belt 10 is tensed. The second shaft bearing 307 is fixed to a second side plate 306*a*. However, the penetrating shaft member 16*a* is not driven rotationally and stops most of time in a print job. Furthermore, the penetrating shaft member 16*a* allows the roller portion 16*b* that tries to follow endless movement of the intermediate transfer belt 10 to rotate freely relative to the penetrating shaft member 16*a* on the circumferential surface thereof.

The elastic layer 16*d* fixed onto the outer circumferential surface of the hollow cored bar 16*c* is made of an EP rubber material that exhibits elasticity of JIS-A hardness of approximately 70 degrees and has a resistance of equal to or lower than 6.0 Log Ω.

Cams as hitting members that hit the secondary transfer roller 24 are fixed to both end regions of the penetrating shaft member 16*a* of the secondary transfer counter roller 16 at the outer sides of the roller portion 16*b* on the entire region thereof in the lengthwise direction. The cams rotate integrally with the penetrating shaft member 16*a*. To be more specific, a first cam 310 is fixed to one end region of the penetrating shaft member 16*a* in the lengthwise direction. A cam portion 310*a* and a round-shaped roller portion 310*b* are formed integrally on the first cam 310 so as to be aligned in the shaft line direction. A parallel pin 80 arranged on the roller portion 310*b* is made to penetrate through the penetrating shaft member 16*a* so as to fix the first cam 310 to the penetrating shaft member 16*a*. Furthermore, a second cam 311 having the same configuration as that of the first cam 310 is fixed to the other end region of the penetrating shaft member 16*a* in the lengthwise direction.

A driving receiving pulley 305 is fixed to an outer region with respect to the second cam 311 in the shaft line direction of the penetrating shaft member 16*a*. Furthermore, a detection subject disc 303 is fixed to an outer region with respect to the first cam 310 in the shaft line direction of the penetrating shaft member 16*a*. On the other hand, a cam driving motor 300 is fixed to a second side plate 306*a* of the intermediate transfer unit and causes a motor pulley 301 provided on the shaft of the cam driving motor 300 to rotate so as to transmit a driving force to the driving receiving pulley 305 fixed to the penetrating shaft member 16*a* through a timing belt 302. With this configuration, the penetrating shaft member 16*a* can be rotated by driving the cam driving motor 300. In this case, even if the penetrating shaft member 16*a* is rotated, movement of the roller portion 16*b* that follows the belt is not inhibited since the roller portion 16*b* can be made to rotate freely relative to the penetrating shaft member 16*a*. Furthermore, if a stepping motor is used as the cam driving motor 300, a motor rotation angle can be set freely without providing a rotation angle detector such as an encoder.

If rotation of the penetrating shaft member 16*a* stops at a predetermined rotation angle, cam portions of the first cam 310 and the second cam 311 hit a first idling roller 312 and a second idling roller 313 supported on the shaft portion of the secondary transfer roller 24, respectively, so as to push back the secondary transfer roller 24 against a biasing force of the biasing coil spring 351 (FIG. 3) attached to the apparatus main body. With this, the secondary transfer roller 24 is moved in the direction of being farther from the secondary transfer counter roller 16 (eventually, the intermediate transfer belt 10) so as to adjust a distance between shafts of the secondary transfer counter roller 16 and the secondary transfer roller 24. With this configuration, a contact/separation unit or a distance adjusting unit that adjusts a distance between the secondary transfer counter roller 16 and the secondary transfer roller 24 is realized by the first cam 310, the second cam 311, the cam driving motor 300, the idling rollers 312 and 313 supported on the shaft portion of the secondary transfer roller 24, and the like. In other words, the contact/separation unit presses the secondary transfer roller 24 against the intermediate transfer belt 10 and to separate the secondary transfer roller 24 from the intermediate transfer belt 10 by moving a pressing lever 354 (shown in FIG. 9) around a fulcrum shaft 359 (shown in FIG. 9) while the secondary transfer unit 350 is attached to the image forming apparatus 100. Then, if the secondary transfer counter roller 16, that is, the penetrating shaft member 16*a* thereof rotates, the cams 310 and 311 fixed to both end portions of the penetrating shaft member 16*a* in the shaft line direction rotate integrally. Therefore, each of the cams at both end sides can be rotated only by providing a driving transmitting mechanism for transmitting driving to the penetrating shaft member 16*a* at one end side in the shaft line direction. A configuration for ensuring driving of the secondary transfer roller 24 when the cam portions of the cams 310 and 311 hit the idling rollers 312 and 313 and push down the secondary transfer roller 24 will be described later. It is to be noted that the cams 310 and 311 may be provided on the shaft portion of the secondary transfer roller 24 and the idling rollers 312 and 313 may be provided on the penetrating shaft member 16*a*. Furthermore, in the embodiment, a configuration in which the image carrier that carries a toner image corresponds to the intermediate transfer belt 10 and the secondary transfer roller 24 is pushed down is employed. However, it can be considered that if auxiliary displaceable tension rollers (for example, rollers biased with springs that abut against both ends of the belt at the outer sides of the image formation region from the belt outer circumferential surface side) that keep a tension state of the intermediate transfer belt 10 are added, the secondary transfer counter roller 16 as the driven roller is displaced without displacing the secondary transfer roller 24. Alternatively, a configuration in which the image carrier that carries the toner image is formed by a photosensitive drum or an intermediate transfer drum and the image carrier is displaced can be considered to be employed.

In the copying machine according to the embodiment, the hollow cored bar 24*b* of the secondary transfer roller 24 is grounded while a secondary transfer bias having the same polarity as the toner is applied to the hollow cored bar 16*c* of the secondary transfer counter roller 16. With this, a secondary transfer electric field for moving the toner from the side of the secondary transfer counter roller 16 to the side of the secondary transfer roller 24 electro-statistically is formed between the rollers in the secondary transfer nip.

The first shaft bearing 308 that supports the penetrating shaft member 16*a* of the secondary transfer counter roller 16 in a freely rotatable manner is formed by a conductive sliding shaft bearing. Note that the penetrating shaft member 16*a* is made of a metal. A high-voltage power supply 309 that outputs the secondary transfer bias is connected to the conductive first shaft bearing 308. The secondary transfer bias to be output from the high-voltage power supply 309 is guided to the secondary transfer counter roller 16 through the conductive first shaft bearing 308. Then, the secondary transfer bias is transmitted to the penetrating shaft member 16*a* made of a metal, the ball shaft bearings 16*e* made of a metal, the hollow cored bar 16*c* made of a metal, and the conductive elastic layer 16*d* in this order in the secondary transfer counter roller 16.

The detection subject disc 303 fixed to one end of the penetrating shaft member 16*a* includes a detection subject portion 303*a* that is erected in the shaft line direction at a predetermined position in the rotating direction of the penetrating shaft member 16*a*. On the other hand, an optical sensor 304 is fixed to a sensor bracket fixed to the first side plate 306*b* of the intermediate transfer unit. In the process in which the penetrating shaft member 16*a* rotates, if the penetrating shaft member 16*a* is located at a predetermined rotation angle range, the detection subject portion 303*a* of the detection subject disc 303 enters between a light emitting element and a light receiving element of the optical sensor 304 so as to shield an optical path therebetween. If the light receiving element of the optical sensor 304 receives light from the light emitting element, the light receiving element transmits a light receiving signal to a controller (not illustrated). The controller grasps the rotation angle positions of the cam portions of the cams 310 and 311 fixed to the penetrating shaft member 16*a* based on a timing at which the light receiving signal from the light receiving element has stopped and a driving amount of the cam driving motor 300 from the timing.

As described above, the first cam 310 and the second cam 311 hit the first idling roller 312 and the second idling roller 313 of the secondary transfer roller 24 at predetermined rotation angles, respectively, so as to push back the secondary transfer roller 24 in the direction of being farther from the secondary transfer counter roller 16 against the biasing force of the biasing coil spring 351 (hereinafter, the pushing-back is referred to as pushing-down). A push-back amount (hereinafter, referred to as push-down amount) in this case is determined by the rotation angle positions of the cams 310 and 311. It is to be noted that as the push-down amount of the secondary transfer roller 24 is larger, the distance between the secondary transfer counter roller 16 and the secondary transfer roller 24 is larger.

The first idling roller 312 provided on the first shaft member 24*c* of the secondary transfer roller 24 such that the first idling roller 312 is rotatable relative to the first shaft member 24*c* is a ball shaft bearing with an outer diameter slightly smaller than that of the secondary transfer roller 24 and is rotatable relative to the first shaft member 24*c* on the circumferential surface of the first shaft member 24*c*. In the same manner, the second idling roller 313 having the same configuration as the first idling roller 312 is provided on the second shaft member 24*d* of the secondary transfer roller 24 such that the second idling roller 313 is rotatable relative to the second shaft member 24*d*.

The rotations of the idling rollers 312 and 313 that have hit the cams 310 and 311 of the secondary transfer counter roller 16 are inhibited with the hitting but the rotation of the secondary transfer roller 24 is not inhibited thereby for the following reason. That is, even if the rotations of the idling rollers 312 and 313 stop, so that the shaft members 24*c* and 24*d* of the secondary transfer roller 24 can rotate freely independent of the idling rollers since the idling rollers are the ball shaft bearings. If the rotations of the idling rollers 312 and 313 are stopped with the hitting of the cams 310 and 311, slide contact therebetween can be prevented from being generated and increase in torques of a belt driving motor and a driving motor of the secondary transfer roller 24 due to the slide contact can be avoided.

Figure 3:
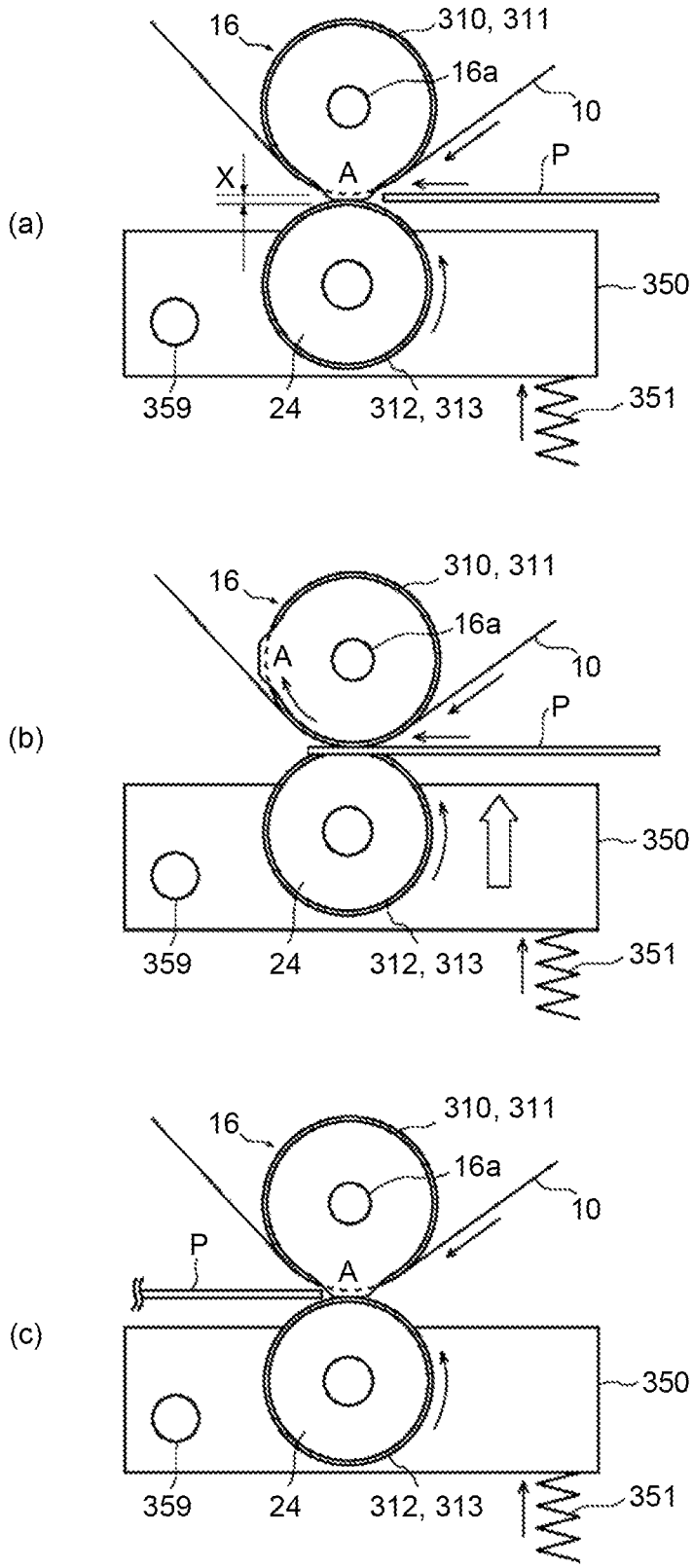
FIG. 3 is a view illustrating a state of a secondary transfer portion relating to the abutment/separation operations of the secondary transfer while paper is being fed, and a recording medium passes through from FIG. 3(*a*) to FIG. 3(*c*)

The abutment/separation operations of the secondary transfer are executed while the copying machine according to the embodiment is being operated in the following cases. That is, the abutment/separation operations are executed when a thick recording medium (hereinafter, referred to as thick paper) is fed, when a toner patch for adjusting a toner density is drawn among a plurality of recording media that are conveyed and pass through the secondary transfer portion during the printing operation, when a discharge pattern of the toner is drawn among the recording media during the printing operation, for example. In FIG. 3, the abutment/separation operations when the thick paper is fed are described in detail. In the copying machine according to the embodiment, when the thick paper is made to enter the secondary transfer nip, as illustrated in FIG. 3(*a*), the rotation of the penetrating shaft member 16*a* of the secondary transfer counter roller 16 is stopped at a position (cam position A) at which the cams 310 and 311 of the secondary transfer counter roller 16 are made to hit the idling rollers 312 and 313 of the secondary transfer roller 24, respectively. That is to say, when the recording medium P as the thick paper is used, the secondary transfer roller 24 is pushed down by the cams 310 and 311 so as to form a space X between the secondary transfer roller 24 and the secondary transfer counter roller 16. If the space X is formed between the secondary transfer roller 24 and the secondary transfer counter roller 16 in this manner, even if the thick paper having a large thickness enters, large fluctuation in load on the intermediate transfer belt 10 and the secondary transfer roller 24 when the thick paper enters the secondary transfer nip is not generated. However, if the recording medium is fed in a state where the secondary transfer roller 24 is pushed down, a sufficient nip pressure is not obtained for the transfer and transfer property of the toner image is deteriorated. In particular, significant deterioration in the transfer rate is observed when the recording medium has poor surface smoothness.

In order to solve the problem, immediately after the recording medium P has entered the secondary transfer nip, as illustrated in FIG. 3(*b*), the penetrating shaft member 16*a* of the secondary transfer counter roller 16 is rotated such that the cams 310 and 311 of the secondary transfer counter roller 16 are located at positions at which the cams 310 and 311 do not hit the idling rollers 312 and 313 of the secondary transfer roller 24, respectively. With this, the cams 310 and 311 are rotated in the clockwise direction or in the counterclockwise direction and are stopped at positions at which they do not make contact with the idling rollers 312 and 313. Then, the cams 310 and 311 are kept being located at the positions at which they do not hit the idling rollers 312 and 313 while an image is being transferred onto the recording medium P. When the recording medium P as the thick paper escapes from the secondary transfer nip, as illustrated in FIG. 3(*c*), the penetrating shaft member 16*a* of the secondary transfer counter roller 16 is rotated and stopped such that the cams 310 and 311 of the secondary transfer counter roller 16 are located at positions at which they hit the idling rollers 312 and 313 of the secondary transfer roller 24.

The operations that are the same as the above-mentioned abutment/separation operations are performed when the toner patch for adjusting the toner density is drawn among the pieces of paper during the printing operation, when the discharge pattern of toner is drawn among the pieces of paper during the printing operation, or the like. With this, separation amounts between front and rear ends of a Procon patch and the nip position and separation amounts between the front and rear ends of the paper and the nip position are matched with high accuracy. It is desirable that the space X between the secondary transfer roller 24 and the secondary transfer counter roller 16 is approximately 1 mm.

In the above description, the abutment/separation operations during the transfer operation onto the recording medium on the secondary transfer portion have been described. However, it is needless to say that the invention can be also applied to a configuration in which an image is transferred directly onto the recording medium from the photosensitive element, and the like. Furthermore, a separation distance between the shafts of the contact/separation unit can be also adjusted by changing the degree of rotation of the cam members with the shaft members so as to respond to the thickness of the recording medium. In this case, it is expected that the thickness of the recording medium is input and directed from an operation panel (not illustrated).

In FIGS. 4A to 4D, positioning when the secondary transfer unit is mounted on the apparatus main body is described. In the copying machine according to the embodiment, a secondary transfer unit 350 as a separated body can be positioned with respect to the intermediate transfer belt when the secondary transfer unit 350 is mounted on the apparatus main body.

Figure 4A:
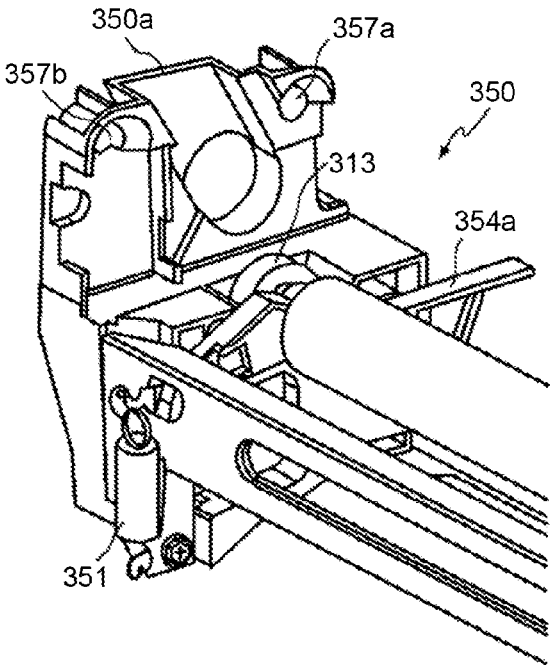
FIGS. 4A to 4D are divided perspective views for explaining positioning when a secondary transfer unit is mounted on an apparatus main body.
Figure 4C:
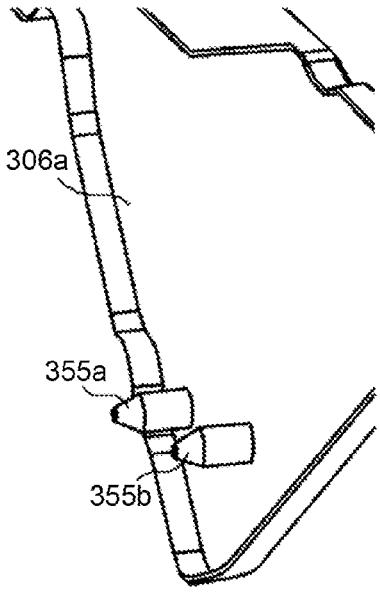
Figure 4B:
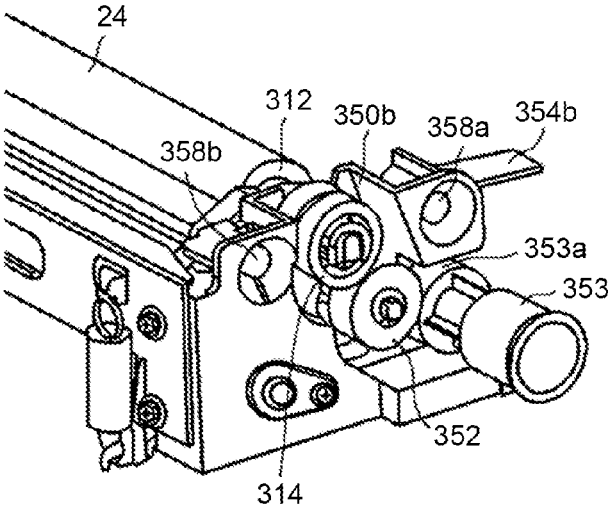
Figure 4D:
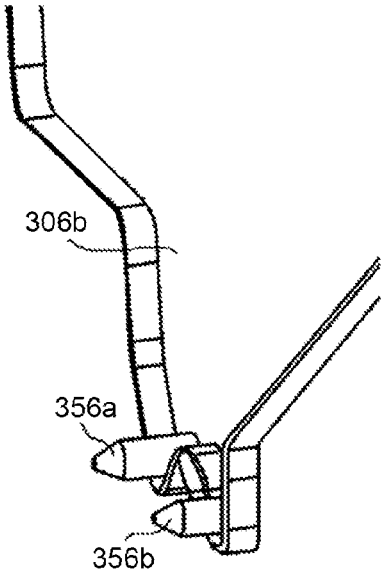

As is obvious from FIG. 4A and FIG. 4B, the secondary transfer unit 350 includes tapered two holes (i.e. two guides) 357*a* and 357*b*, and 358*a* and 358*b* on each of a front side frame 350*a* (i.e. unit frame) (FIG. 4A) and a rear side frame 350*b* (i.e. unit frame) (FIG. 4B). On the other hand, tapered two pins 355*a* and 355*b*, and 356*a* and 356*b* are provided at the front sides (sides of the copying machine that are opposed to an operator) of the second side plate 306*a* (FIG. 4C) as a front side plate of the intermediate transfer unit and the first side plate 306*b* (FIG. 4D) as a rear side plate thereof in a projection manner. It is to be noted that the pins 355*a* and 355*b*, and 356*a* and 356*b* as the positioning portions are not limited to two for each of the side plates 306*a* and 306*b* as illustrated in FIGS. 4C and 4D and may be one or equal to or more than three for each of them. In accordance therewith, the positions and the number of tapered holes 357*a* and 357*b*, and 358*a* and 358*b* as the positioning holes are changed.

Figure 5:
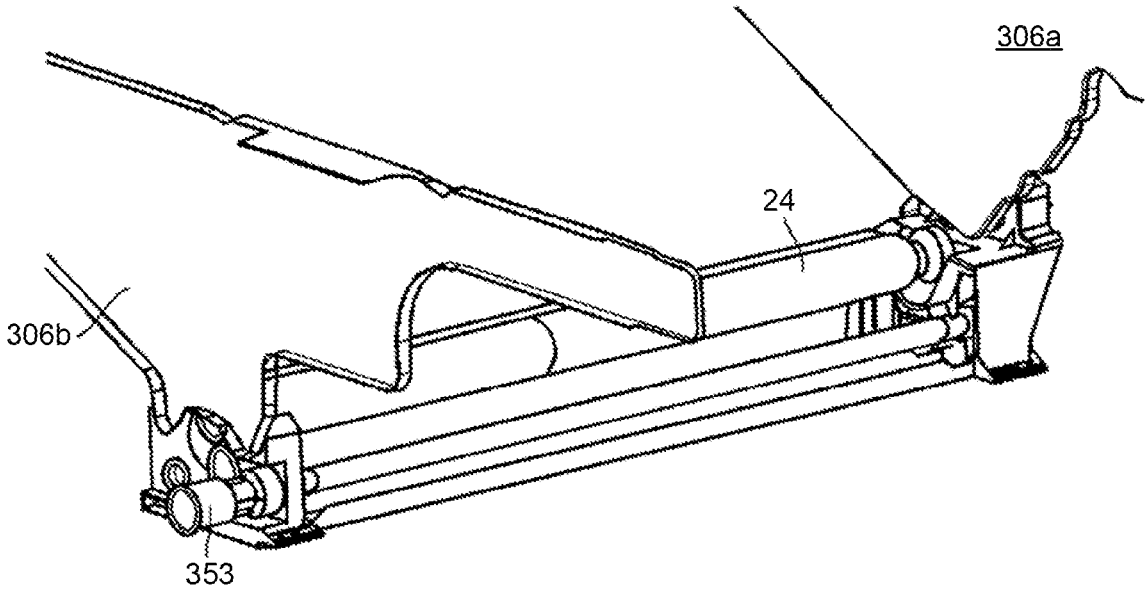
FIG. 5 is a partial perspective view at the time of positioning.

The secondary transfer unit 350 is held on a drawer unit (not illustrated) that slides so as to be drawn from the apparatus main body to the front side. In a state where the drawer unit is drawn out from the apparatus main body, the secondary transfer unit 350 is held on the drawer unit so as to be movable by some extent in the right-left direction, the depth direction, and the up-down direction when seen from the front side of the main body. For example, the secondary transfer unit 350 is movable to each of the right and left sides by 1 mm in the right-left direction, to each of the front and rear sides by 1 mm in the depth direction, and to the upper side by 3 mm in the up-down direction. If the drawer unit that holds the secondary transfer unit 350 is mounted on and stored in the apparatus main body, the tapered holes 358*a* and 358*b* provided on the rear side frame 350*b* of the secondary transfer unit 350 are fitted with the tapered pins 356*a* and 356*b* provided on the first side plate 306*b* of the intermediate transfer unit, respectively. At the substantially same timing, the tapered holes 357*a* and 357*b* provided on the front side frame 350*a* of the secondary transfer unit 350 are fitted with the tapered pins 355*a* and 355*b* provided on the second side plate 306*a* of the intermediate transfer unit, respectively. With this, the front and rear positions of the secondary transfer roller are determined with high accuracy. In addition, the surface of the rear side frame 350*b* of the secondary transfer unit 350 and the first side plate 306*b* of the intermediate transfer unit hit each other. With the above-mentioned fittings and hitting, the secondary transfer unit 350 is fixed to the intermediate transfer unit, therefore, to the apparatus main body, and is positioned (i.e. guided or aligned) so as not to be movable in the right-left direction, the depth direction, and the up-down direction when seen from the front side of the main body. Accordingly, the secondary transfer unit can be positioned reliably even when a pressing force of the secondary transfer is large. Then, the secondary transfer unit 350 is biased to the side of the intermediate transfer belt with the biasing coil spring 351 (see FIG. 3) attached to the apparatus main body, so that the secondary transfer roller is made to abut against the intermediate transfer belt accurately. As collecting illustration in FIGS. 4A to 4D, a state as illustrated in FIG. 5 is realized.

Figure 6:
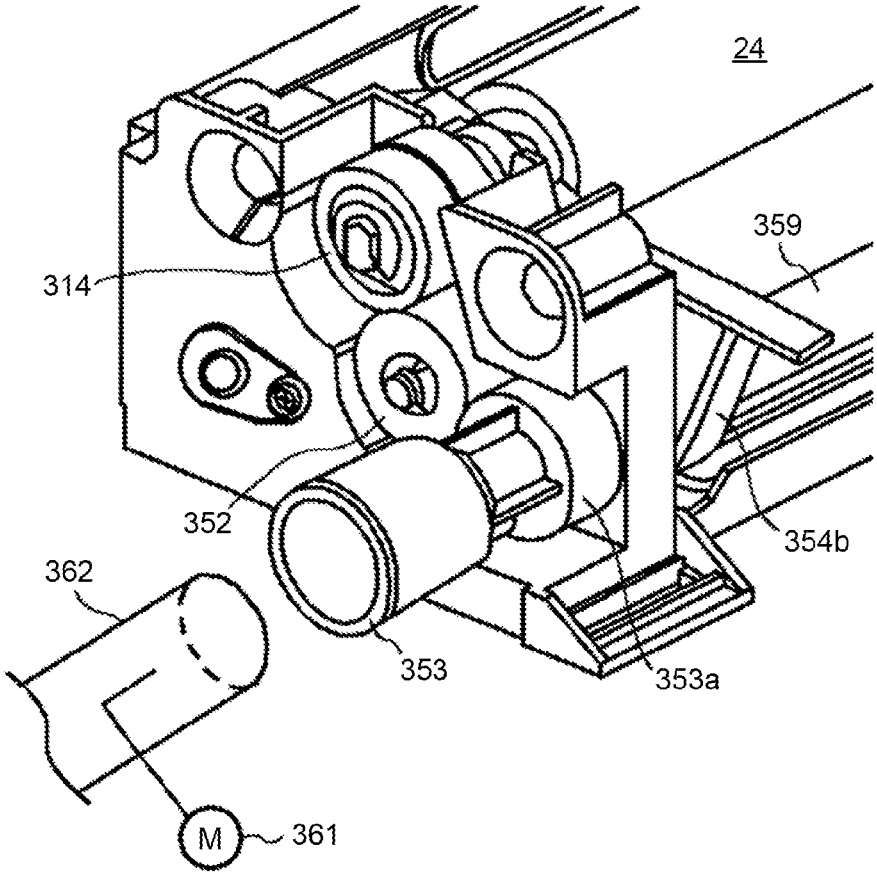
FIG. 6 is a partial perspective view for explaining driving of the secondary transfer.

In FIG. 6, driving of the secondary transfer is described. Driving is input to the secondary transfer unit 350 by a joint 353 through a driving transmitting member 362 from a motor 361 for driving the secondary transfer roller at the rear side of the unit. The driving input to the joint 353 is transmitted to an idler gear 352 from a driving gear 353*a* formed integrally with the joint 353. The driving transmitted to the idler gear 352 is transmitted to a roller driving gear 314 arranged on a shaft end of the secondary transfer roller 24 so as to drive the secondary transfer roller 24. It is to be noted that the idler gear 352 to be interposed between the roller driving gear 314 and the driving gear 353*a* as illustrated in FIG. 6 is not limited to one and a plurality of idler gears 352 can be interposed therebetween.

Figure 7:
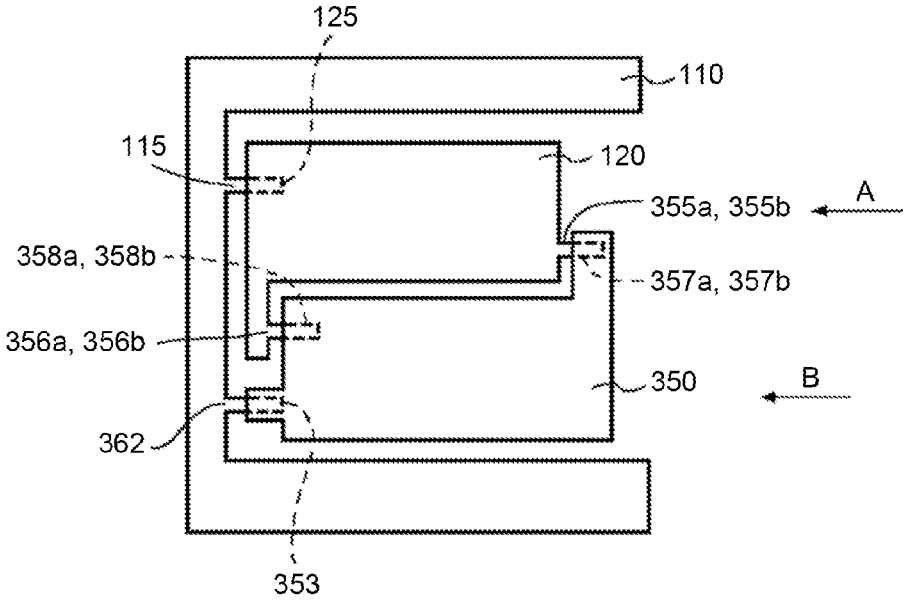
FIG. 7 is a conceptual plan view schematically illustrating the color copying machine in FIG. 1 when seen from the side.

The driving transmitting member 362 for transmission from the motor 361 as the driving source and the joint 353 are configured to permit backlash to some extent. The following describes a reason why the fitting backlash (allowance) is provided on the driving transmitting member 362 and the joint 353. FIG. 7 is a conceptual plan view schematically illustrating the copying machine in FIG. 1 when seen from the side. The apparatus main body 110 (i.e. a housing) includes an intermediate transfer unit positioning portion (for example, pin) 115 and the driving transmitting member 362 connected to the motor 361. If an intermediate transfer unit 120 is moved in the horizontal direction, that is, in the direction as indicated by an arrow A in FIG. 7, an intermediate transfer unit positioning hole 125 provided on the intermediate transfer unit 120 and the intermediate transfer unit positioning portion 115 provided on the apparatus main body 110 are fitted with each other. They are fitted with each other, so that the intermediate transfer unit 120 is positioned with respect to the apparatus main body 110. If the secondary transfer unit 350 is moved in the horizontal direction, that is, in the direction as indicated by an arrow B in FIG. 7 in a state where the intermediate transfer unit 120 is positioned with respect to the apparatus main body 110, the holes 358*a* and 358*b* of the secondary transfer unit 350 and the pins 356*a* and 356*b* of the intermediate transfer unit 120 are fitted with each other, and the holes 357*a* and 357*b* of the secondary transfer unit 350 and the pins 355*a* and 355*b* of the intermediate transfer unit 120 are fitted with each other. With the fittings of the members, the secondary transfer unit 350 is positioned with respect to the intermediate transfer unit 120. Furthermore, the driving transmitting member 362 and the joint 353 are fitted with each other with the movement of the secondary transfer unit 350. Note that an error is generated on the position of the driving transmitting member 362 with respect to the positioning pins 356*a* and 356*b*, and 355*a* and 355*b* on the apparatus main body and the intermediate transfer unit due to tolerance of parts or the like in some cases. In the same manner, an error is also generated on the position of the joint 353 with respect to the positioning holes 358*a* and 358*b*, and 357*a* and 357*b* on the secondary transfer unit 350 in some cases. When there is no fitting backlash on the driving transmitting member 362 and the joint 353, there is a possibility that the driving transmitting member 362 and the joint 353 cannot be fitted with each other due to any one or both of the above-mentioned errors. Alternatively, even if they can be fitted with each other, there is also a possibility that a stress is applied to the driving transmitting member 362, the joint 353, the secondary transfer unit 350, the apparatus main body 110, or the like and they are broken. In the embodiment, the above-mentioned failures can be prevented by providing the fitting backlash (allowance) on the driving transmitting member 362 and the joint 353. It is desirable that the fitting backlash of the driving transmitting member 362 and the joint 353 is in a range of ±0.8 mm. It is to be noted that a configuration in which the apparatus main body 110 and the intermediate transfer unit 120 are provided integrally may be employed instead of a configuration in which the intermediate transfer unit can be attached to the apparatus main body.

Figure 8:
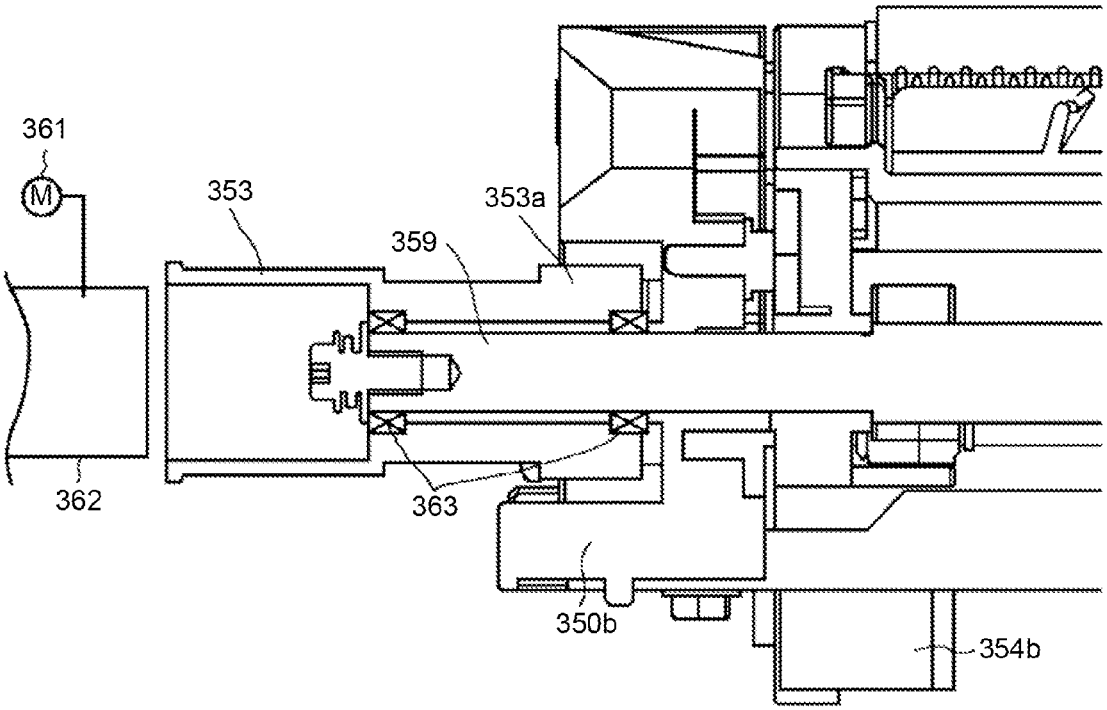
FIG. 8 is a partial cross-sectional view illustrating a rear side frame in the vicinity of a joint.
Figure 9:
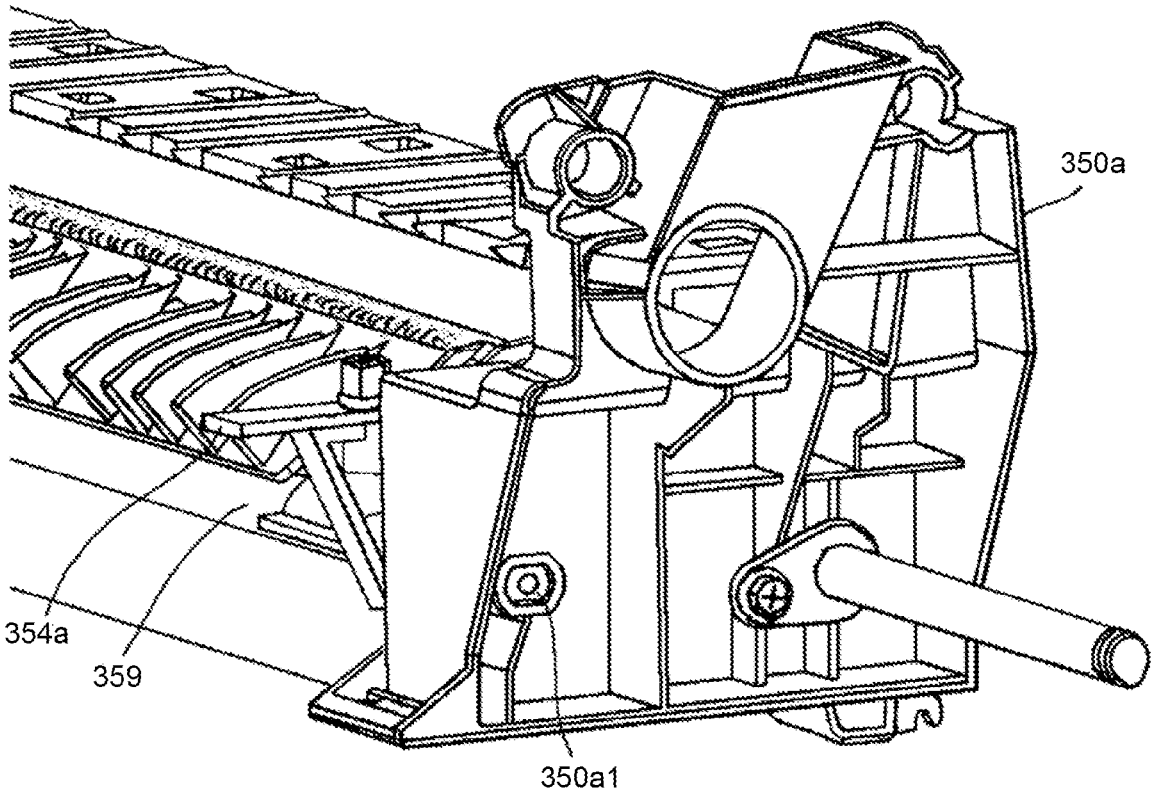
FIG. 9 is a perspective view illustrating a front side frame when seen from the outer side.

The joint 353 and the driving gear 353*a* that has been formed integrally with the joint are arranged coaxially with an abutment/separation operation fulcrum shaft 359 (pressing lever fulcrum shaft, also illustrated in FIG. 3) of the secondary transfer roller 24. The abutment/separation operation fulcrum shaft 359 is held on a secondary transfer roller pressing lever 354 (354*a* in FIG. 4A, 354*b* in FIG. 4B and FIG. 6) as a movable frame through a ball shaft bearing. The pressing lever 354 and the fulcrum shaft 359 have a relationship of a sliding shaft bearing. The fulcrum shaft 359 itself is held on the secondary transfer unit 350 in a non-rotatable state. As illustrated in FIG. 8, the joint 353 is attached to the fulcrum shaft 359 through shaft bearings 363 together with the integrated driving gear 353*a*. Therefore, the joint 353 is configured to be rotatable around the fulcrum shaft. It is to be noted that an oval cut portion 350*a*1 is formed on the front side frame 350*a* on the front side shaft end of the fulcrum shaft 359 and restricts (i.e. regulates) the fulcrum shaft 359 from rotating (FIG. 9). This is because if the fulcrum shaft 359 is rotated, a fulcrum hole of the pressing lever 354*a* is abraded.

Figure 10:
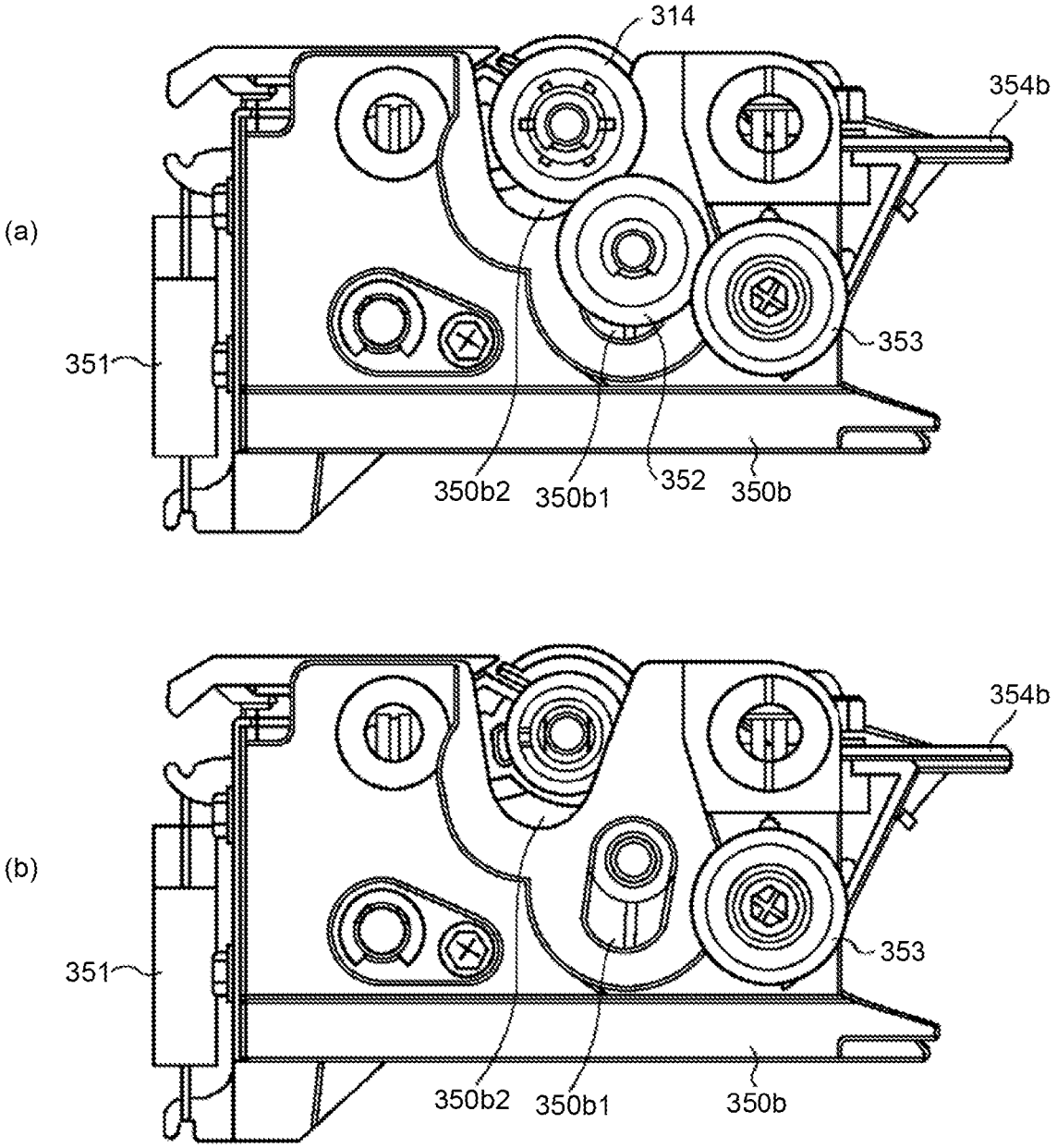
FIG. 10 is a view illustrating the secondary transfer unit when seen from the side of a first side plate, FIG. 10(*a*) is a view illustrating the secondary transfer unit including a roller driving gear and an idler gear and FIG. 10(*b*) is a view illustrating the secondary transfer unit when the roller driving gear and the idler gear are detached.
Figure 11:
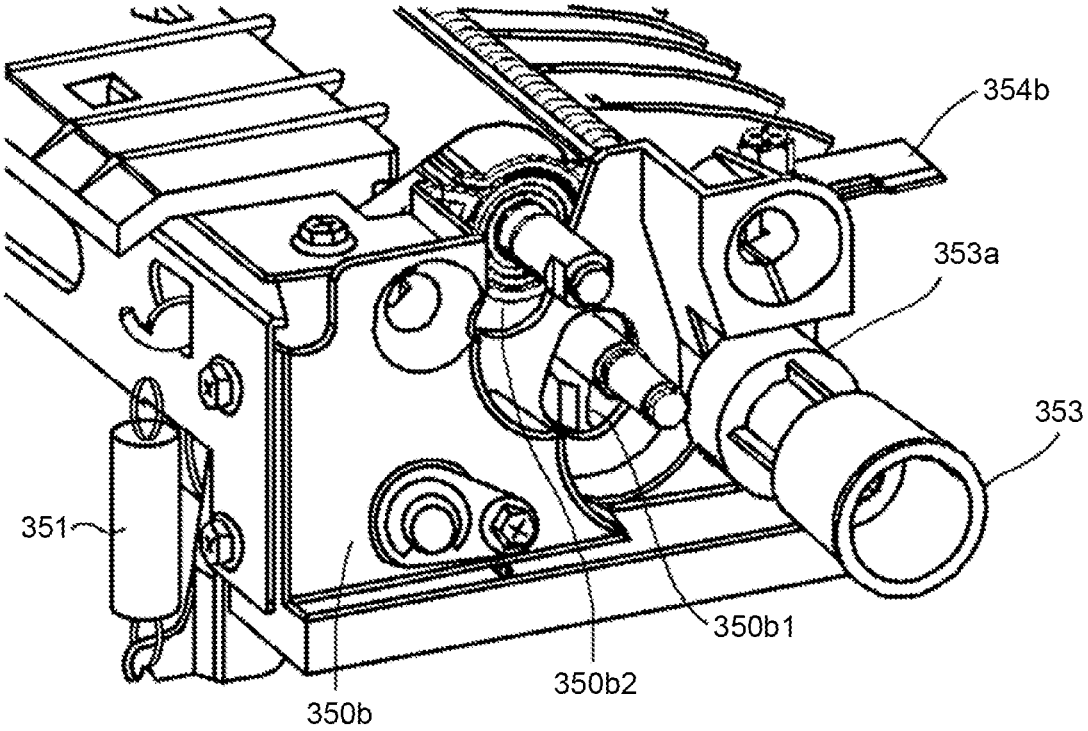
FIG. 11 is a perspective view corresponding to FIG. 10(*b*).

A configuration for ensuring driving of the secondary transfer roller when the cams 310 and 311 hit the idling rollers 312 and 313, respectively, so as to push down the secondary transfer roller 24 during driving is described finally. FIG. 10 is a view illustrating the secondary transfer unit 350 when seen from the side of the first side plate 306*b* of the intermediate transfer unit. In comparison with FIG. 10(*a*), FIG. 10(*b*) illustrates a state where the roller driving gear 314 and the idler gear 352 are detached. FIG. 4B is a perspective view corresponding to FIG. 10(*a*) and FIG. 11 is a perspective view corresponding to FIG. 10(*b*). The secondary transfer roller pressing lever 354*b* as a movable frame that enables contact and separation between the secondary transfer roller and the secondary transfer belt/the secondary transfer counter roller can be moved rotationally about the fulcrum shaft arranged coaxially with the joint 353. When the secondary transfer roller is separated from the intermediate transfer belt, the cams and the idling rollers hit each other and the secondary transfer roller is pushed down. With this, the roller driving gear 314 arranged on the roller shaft end is also pushed down. However, the roller shaft is held on the pressing lever 354*b* together with the idler gear shaft. Therefore, even when the pressing lever 354*b* rotates about the fulcrum shaft during driving, distances among shafts of the roller driving gear 314, the idler gear 352, and the driving gear of the joint 353 are not changed. With this configuration, even if the abutment/separation operations are executed, engagements of the gears (distances among the shafts) can be kept accurately and gear driving with high accuracy, therefore, driving of the secondary transfer roller is ensured. Furthermore, when the roller driving gear 314 and the idler gear 352 moves up and down, openings that cover movement tracks of the idler gear shaft and the roller driving gear shaft are provided on the rear side frame 350*b* so as not to interfere with the rear side frame 350*b* positioned and fixed onto the first side plate 306*b* of the intermediate transfer unit. In the example as illustrated in FIGS. 10(*a*) and 10B, a long hole 350*b*1 as an opening for the idler gear shaft and a cutout 350*b*2 as an opening for the roller driving gear shaft are provided.

According to the embodiment, a configuration that positions the transfer unit supporting the transfer member (for example, secondary transfer roller) with respect to the image carrier (for example, intermediate transfer belt) is provided. While the transfer member is driven in the state where the configuration positions the transfer unit with respect to the image carrier, the contact/separation unit operates independently of driving of the transfer member. Therefore, relative positions of the transfer member and the image carrier can be achieved with high accuracy and image quality is not deteriorated due to pressure deviation or the like.

And according to the embodiment, an image forming apparatus includes: an image carrier that carries a toner image; a driving source; a first driving transmitting member configured to be driven by a driving force generated by the driving source; and a transfer unit that is detachably attachable to a housing of the image forming apparatus. The transfer unit includes: a transfer member configured to contact the image carrier directly or via a recoding medium to form a transfer nip and transfer the toner image on the image carrier onto the recording medium passing through the transfer nip; a guide configured to guide the transfer unit to the image carrier; a fulcrum shaft; a movable frame that supports the transfer member and configured to rotate around the fulcrum shaft; a driving input member coaxially arranged with the fulcrum shaft and configured to connect to the first driving transmitting member, and a second driving transmitting member supported by the movable frame and configured to transmit the driving force inputted by the driving input member to the transfer member. The image forming apparatus further includes a contact/separation unit configured to press the transfer member against the image carrier and to separate the transfer member from the image carrier by moving the movable frame around the fulcrum shaft while the transfer unit is attached to the image forming apparatus.

In the image forming apparatus, the contact/separation unit may be configured to press the transfer member against the image carrier and to separate the transfer member while the driving force of the driving force is transmitted to the transfer member.

In the image forming apparatus, the driving input member may include a joint configured to fit with the first driving transmitting member along an attaching direction of the transfer unit with an allowance between the joint and the first driving transmitting member. The allowance is provided in a direction which is perpendicular to the attaching direction.

The image forming apparatus may further include: a support member that supports the image carrier and is opposed to the transfer member via the image carrier. In this case, the contact/separation unit may include: a cam supported by any one of a shaft of the support member and the transfer member, and a second driving source configured to drive the cam. The contact/separation unit may bring the transfer member into contact with the image carrier and separate the transfer member from the image carrier by driving the cam.

In the image forming apparatus, the second driving transmitting member may include: a driving gear that is coaxially arranged with the fulcrum shaft and configured to rotate integrally with the driving input member; an idler gear that is engaged with the driving gear, and a transfer member driving gear that is engaged with the idler gear and is coaxially arranged with the transfer member and configured to rotate integrally with the transfer member In the image forming apparatus, the transfer unit may include a unit frame that supports the fulcrum shaft.

In the image forming apparatus, the unit frame may include a regulate portion that regulates rotation of the fulcrum shaft.

In the image forming apparatus, the driving input member may be rotatably connected to the fulcrum shaft via a bearing.

In the image forming apparatus, the guide may be arranged on the unit frame.

The image forming apparatus may further include a image carrier unit that supports the image carrier. In this case, the image carrier unit is detachably attachable to the housing of the image forming apparatus.

According to the embodiment, both rotating center of the movable frame rotated by the contact/separation unit and driving input member are provided on the fulcrum shaft. Therefore, a distance between the fulcrum shaft and a shaft of the transfer member can be maintained with high accuracy and the transfer member can be driven with high accuracy even if the abutment/separation operations are performed. Further, because both fulcrum shaft and transfer member are provided in the transfer unit, the distance between the fulcrum shaft and the shaft of the transfer member can be maintained with high accuracy and the transfer member can be driven with high accuracy even if the transfer unit is attached with the position of the transfer unit relative to the image carrier deviating from the regular position due to tolerance of parts.

Further, the productivity of the apparatus can be maintained, or fluctuation in load in the image carrier and the transfer member can be prevented.

Further, the joint and the first driving transmitting member can be prevented from being broken.

Further, the riving force of the driving source can be transmitted to the transfer member via the relatively simple configuration.

Further, the fulcrum shaft can be supported by the transfer unit using the relatively simple configuration.

Further, ease in replacing or attaching and detaching the image carrier can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier that carries a toner image;

a driving source;

a first driving transmitting member configured to be driven by a driving force generated by the driving source;

a transfer unit that is detachably attachable to a housing of the image forming apparatus and includes:

a transfer member configured to contact the image carrier directly or via a recoding medium to form a transfer nip and transfer the toner image on the image carrier onto the recording medium passing through the transfer nip;

a guide configured to guide the transfer unit to the image carrier;

a fulcrum shaft;

a movable frame that supports the transfer member and configured to rotate around the fulcrum shaft;

a driving input member coaxially arranged with the fulcrum shaft and configured to connect to the first driving transmitting member via a joint that receives and holds the driving input member, and a second driving transmitting member supported by the movable frame and configured to transmit the driving force inputted by the driving input member to the transfer member, and a contact/separation unit configured to press the transfer member against the image carrier and to separate the transfer member from the image carrier by moving the movable frame around the fulcrum shaft while the transfer unit is attached to the image forming apparatus.

2. The image forming apparatus according to claim 1, wherein the contact/separation unit configured to press the transfer member against the image carrier and to separate the transfer member while the driving force of the driving force is transmitted to the transfer member.

3. The image forming apparatus according to claim 1, wherein the joint is configured to fit with the first driving transmitting member along an attaching direction of the transfer unit with an allowance between the joint and the first driving transmitting member, the allowance being provided in a direction which is perpendicular to the attaching direction.

4. The image forming apparatus according to claim 1, further comprising:

a support member that supports the image carrier and is opposed to the transfer member via the image carrier, wherein the contact/separation unit includes:

a cam supported by any one of a shaft of the support member and the transfer member, and a second driving source configured to drive the cam, the contact/separation unit bringing the transfer member into contact with the image carrier and separating the transfer member from the image carrier by driving the cam.

5. The image forming apparatus according to claim 1, wherein the second driving transmitting member includes:

a driving gear that is coaxially arranged with the fulcrum shaft and configured to rotate integrally with the driving input member;

an idler gear that is engaged with the driving gear, and a transfer member driving gear that is engaged with the idler gear and is coaxially arranged with the transfer member and configured to rotate integrally with the transfer member.

6. The image forming apparatus according to claim 1, wherein the transfer unit includes a unit frame that supports the fulcrum shaft.

7. The image forming apparatus according to claim 6, wherein the unit frame includes a regulate portion that regulates rotation of the fulcrum shaft.

8. The image forming apparatus according to claim 7, wherein the driving input member is rotatably connected to the fulcrum shaft via a bearing.

9. The image forming apparatus according to claim 6, wherein the guide is arranged on the unit frame.

10. The image forming apparatus according to claim 1, further comprising:

a image carrier unit that supports the image carrier, wherein the image carrier unit is detachably attachable to the housing of the image forming apparatus.

11. An image forming apparatus comprising:

an image carrier that carries a toner image;

a transfer member that abuts against the image carrier to form a transfer nip and transfers the toner image on the image carrier onto a recording medium passing through the transfer nip;

a transfer unit that supports the transfer member;

a driving source that drives the transfer member; and a contact/separation unit that causes the transfer member to abut against and to be separated from the image carrier;

wherein:

the transfer unit includes a movable frame that enables contact and separation between the image carrier and the transfer member, the movable frame includes a first gear provided on a fulcrum shaft, an idler gear that is engaged with the first gear, and a transfer member driving gear that is engaged with the idler gear, and the movable frame moves around the fulcrum shaft together integrally with the idler gear and the transfer member driving gear, and while the transfer member is driven in a state to configure the transfer unit, the contact/separation unit operates independently of driving the transfer member.

12. The image forming apparatus according to claim 11, wherein a cam member is fixed immovably to any one of a shaft portion of the image carrier and a shaft portion of the transfer member, an idling member that is rotatable relative to the other of the shaft portion of the image carrier and the shaft portion of the transfer member at a position corresponding to the cam member is supported on the other of the shaft portion of the image carrier and the shaft portion of the transfer member, the shaft portion to which the cam member is fixed immovably supports the image carrier or the transfer member such that the image carrier or the transfer member is rotatable relative to the shaft portion to which the cam member is fixed immovably, and the cam member is rotated at predetermined timing so as to cause the transfer member to abut against and to be separated from the image carrier.

13. The image forming apparatus according to claim 11, wherein the transfer unit includes a second frame that is positioned with respect to the image carrier, and the second frame has an opening corresponding to a track along which the idler gear moves when the movable frame is moved for the contact and separation.

14. The image forming apparatus according to claim 11, wherein the transfer unit includes a second frame that is positioned with respect to the image carrier, and the second frame has a second opening corresponding to a track along which the transfer member driving gear moves when the movable frame is moved for the contact and separation.

15. The image forming apparatus according to claim 11, wherein the fulcrum shaft is held on the transfer unit in a non-rotatable state, and the first gear is supported on the fulcrum shaft through a bearing.

16. The image forming apparatus according to claim 11, wherein a separation distance between the image carrier and the transfer member is changeable.

17. The image forming apparatus according to claim 11, further comprising:

a joint that is provided integrally with the first gear, and a driving transmitting member that transmits a driving force of the driving source to the joint.

18. The image forming apparatus according to claim 11, wherein the image carrier is an intermediate transfer belt, and the transfer member is a secondary transfer roller.

19. An image forming apparatus comprising:

an image carrier that carries a toner image;

a transfer member that abuts against the image carrier to form a transfer nip and transfers the toner image on the image carrier onto a recording medium passing through the transfer nip;

a transfer unit that supports the transfer member;

a driving source that drives the transfer member;

a contact/separation unit that causes the transfer member to abut against and to be separated from the image carrier;

a cam member is fixed immovably to any one of a shaft portion of the image carrier and a shaft portion of the transfer member; and an idling member that is rotatable relative to the other of the shaft portion of the image carrier and the shaft portion of the transfer member at a position corresponding to the cam member is supported on the other of the shaft portion of the image carrier and the shaft portion of the transfer member, wherein:

the shaft portion to which the cam member is fixed immovably supports the image carrier or the transfer member such that the image carrier or the transfer member is rotatable relative to the shaft portion to which the cam member is fixed immovably, the cam member is rotated at predetermined timing so as to cause the transfer member to abut against and to be separated from the image carrier, and while the transfer member is driven in a state to configure the transfer unit, the contact/separation unit operates independently of driving the transfer member.

* * * * *